INVENTOR
JEAN R. GAILLOCHET

BY Young and Tarolli
ATTORNEYS

INVENTOR
JEAN R. GAILLOCHET
BY Young and Tarolli
ATTORNEYS

INVENTOR
JEAN R. GAILLOCHET
BY Young and Tarolli
ATTORNEYS

INVENTOR
JEAN R. GAILLOCHET
BY Young and Tarolli
ATTORNEYS

AUTOMATIC DEVICE FOR THE REMOTE ADJUSTMENT OF THE INKING BLADE OF A PRINTING MACHINE

The present invention relates to a device for adjusting the position of the flexible blade of the ink-trough of a printing machine.

In the printing industry, it is common practice to employ an inking device constituted by a cylindrical roller to which is given a movement of rotation, continuous or otherwise, and partly dipping into a trough filled with ink, the coating of ink carried by this roller being transferred to a second roller. In order to transmit to this second roller only the quantity of ink exactly necessary for the requirements of printing, there is interposed on the periphery of the first roller and on the upstream side of the second roller, a flexible blade, the position of which, adjusted by means of control rods, determines the quantity of ink retained by the said first roller.

The known remote-control devices for the position of the blade, whether these are mechanical or electromagnetic, have the disadvantage of a risk of failure to operate of one or more of the control rods, due to seizure or getting out of order of one of the numerous elements of the remote-control. These risks of operational failure are very great and create an insecurity of use which is incompatible with the regular production of modern machines.

The remote-control device according to the invention permits this drawback to be obviated and provides reliable and durable operation.

According to the invention, the position of each of the control rods is determined by the rotation of a screw actuated by an independent electric motor, the direction and amount of the rotation being determined by means of a remote-control.

In a first form of embodiment of the invention, the remote-control of the motors associated with the screws comprises at least one rotary switch which is brought into its neutral position by a motor.

In a second form of embodiment of the invention, the remote-control of the motors associated with the screws comprises at least one meter with manual display and deducation by impulses. The impulses are supplied by the motors in numbers proportional to the amount of their rotation, the manual display corresponding to the desired value of rotation.

In a third form of embodiment of the invention, the screws are differential screws.

The device according to the invention is advantageously completed by an independent control operating by all or nothing and enabling the inking blade to be placed in a position such that no transfer of ink takes place, over at least a portion of the second roller.

Again advantageously, the device is completed by manual control means.

Other characteristics, advantages and particular features of the invention will be brought out in the description which is given below with reference to the accompanying drawings, showing by way of explanation and not in any limitative sense, one possible form of construction of the said invention.

Figure 1:
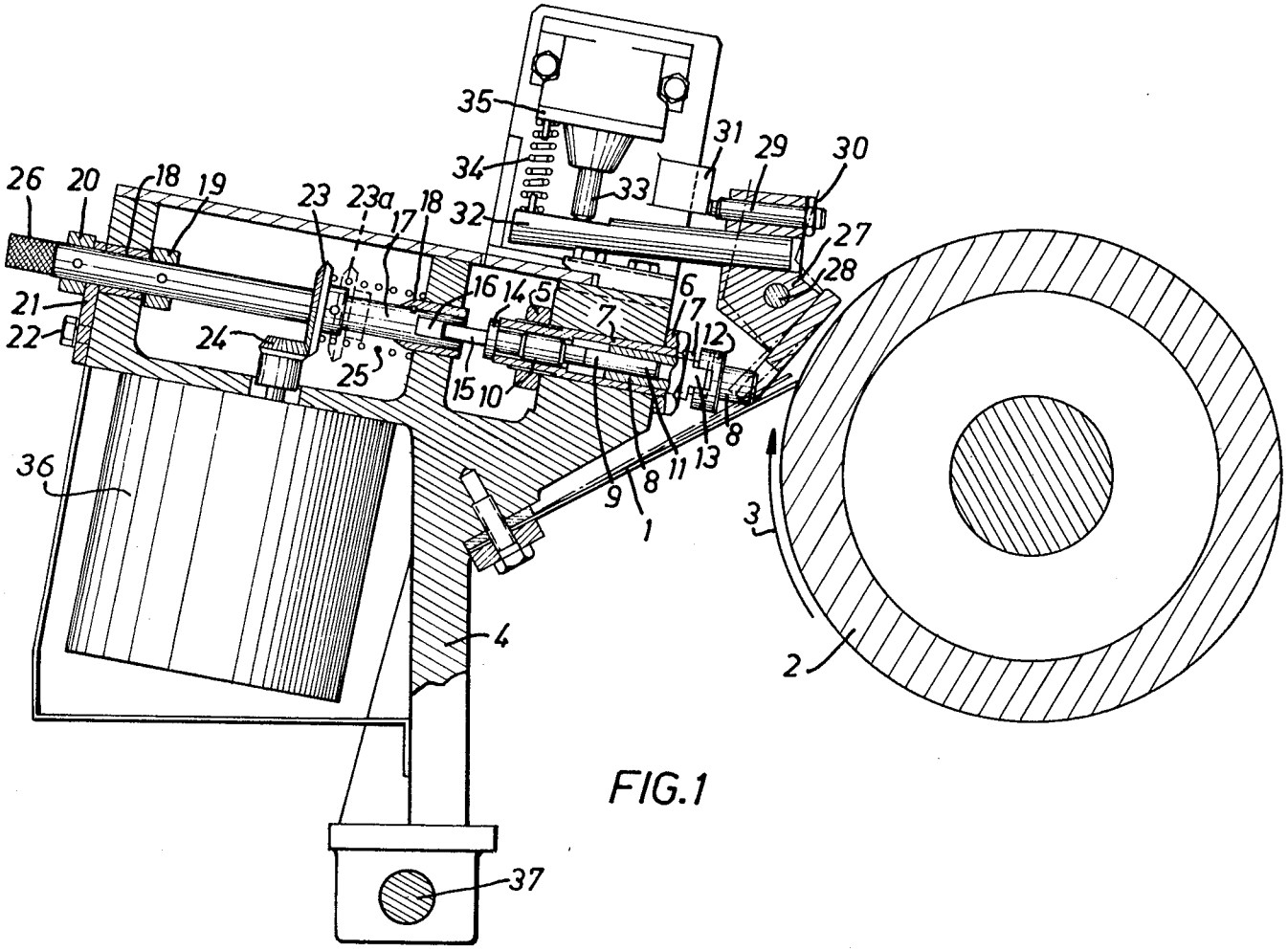
FIG. 1 is a view, partly in cross-section, of a regulating device according to the invention.

The device shown in FIG. 1 serves to regulate the position of an inking blade 1 with respect to an inking cylinder 2, dipping partly into a trough of ink (not shown) and driven in rotation in the direction of the arrow 3; this movement of rotation may or may not be continuous.

One of the extremities of the blade 1 is fixed on a cross-frame 4. This cross-frame is provided with a bore in which an externally-threaded socket 7 is fixed by means of two nuts 5 and 6.

The socket 7 is also threaded internally at one of its extremities and comprises at its other extremity, a bore in which a ring 8 is capable of sliding, the free extremity of this ring being supported on the free extremity of the blade 1 so as to maintain it in the vicinity or in contact with the inking roller 2, as will be explained later.

A rod 9 comprises a first threaded portion 10 co-operating with the internal threading of the socket 7, and a second threaded portion 11 co-operating with the threading formed in the interior of the ring 8. The pitch of the threaded portion 10 is greater than that of the threads 11 for reasons which will be explained subsequently.

Figure 2:
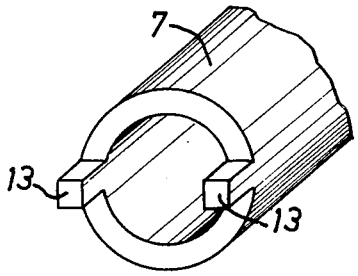
FIG. 2 is a view in perspective of a contructional detail of the device of FIG. 1.
Figure 4:
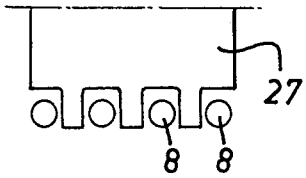
FIG. 4 is a diagrammatic view of the layout of the regulating device by differential screw and of a regulating device operating by all or nothing.
Figure 3:
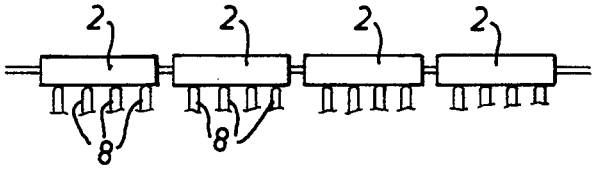
FIG. 3 shows diagrammatically the layout of the regulating devices on a printing machine.

A split ring 12 is pinned on the portion of the ring 8 outside the cross-frame 4, the slots of this ring 12 engaging on two nipples 13 formed at the end of the socket 7 and shown in perspective in FIG. 2. As the socket 7 is fixed on the cross-frame 4 by the nuts 5 and 6, the ring 12 fixes the ring 8 in rotation while leaving it free to slide inside the socket 7.

The rod 9 comprises a shoulder 14 capable of coming into abutment against the socket 7, and the extremity 15 of the rod 9, farthest away from the blade 1, has a square section which is housed in a slot 16 of a driving shaft 17. The shaft 17 rotates in two bearings 18 fixed on the cross-frame 4, and the axial displacement which it is capable of receiving is limited by two abutments 19 and 20, pinned on it, and by another abutment 21 placed between the abutment 20 and the cross-frame 4, this latter abutment 21 being fixed to the cross-frame 4 by a bolt 22 serving as an axis of rotation, so that the abutment 21 can be withdrawn for the purpose of manual regulation, as will be explained below.

A bevel pinion 23 fixed on the shaft 17 co-operates with a driving pinion 24, and a spring 25 working in compression acts so as to displace the shaft 17 towards the left of FIG. 1.

The free extremity of the shaft 17 is given the form of a knurled knob 26.

A certain number of devices such as those described above are placed side by side so as to actuate the blade 1 at different points of its width. The layout of these against the socket 7, whereby limiting the displacement of blade 1 towards the roller 2 and thus avoiding damage to either the blade or the roller. The nuts 5 and 6 co-operating with the socket 7 and the cross-frame permit adjustment of movement of the ring 8 in this direction.

If it is desired to carry out a manual regulation, the abutment 21 is withdrawn by rotation about 22. By acting on the knurled knob 26 so as to overcome the force of the spring 25, the teeth of the pinion 23 are disengaged from those of the pinion 24 and the shaft 17 can then be rotated manually. When action on the knob 26 is stopped, the spring 25 ensures the return of the pinion 23 to its engaged position with the pinion 24. It will be noted that there is sufficient play between the bottom of the slot 16 and the square rod 15 to permit axial movement of the shaft 17 referred to above.

Figure 7:
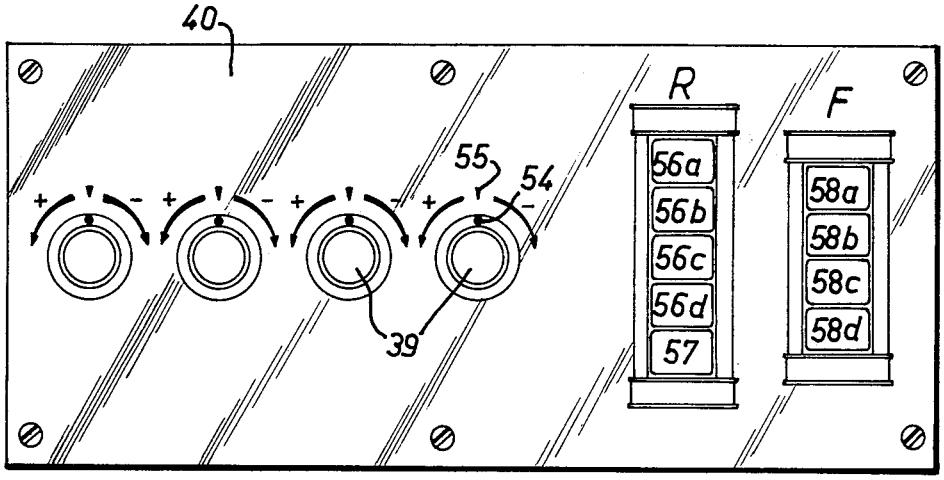
FIG. 7 is a view in elevation of the operating switchboard of this first form of embodiment.
Figure 5:
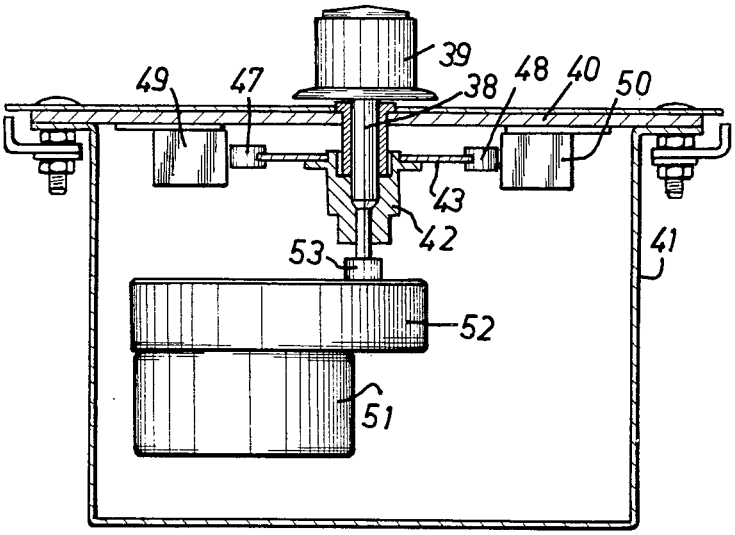
FIG. 5 is a partial view in cross-section of a first form of embodiment of the remote-control device.
Figure 6:
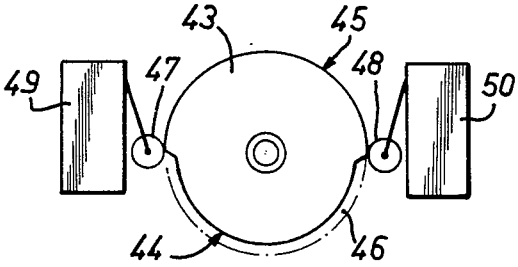
FIG. 6 is a partial view looking on the top of FIG. 5.

The automatic remote-control of the motor 36 by means of the device described with reference to FIGS. 5 to 7 is as follows:

The knob 39 corresponding to the motor 36 considered is moved in the direction of the arrow "+" or of the arrow "–" marked on the cover 40, depending on whether it is desired to rotate the rod 9 in the direction for increasing or reducing the space between the blade 1 and the roller 2. According to the direction of rotation of the knob 39, which rotation causes that of the disc 43, one of the cam-rollers 47 or 48 becomes placed in the groove 46, closing the circuit of the associated switch 49 or 50, each of these switches controlling the direction of rotation of the motors 36 and 51, the motor 51 in the direction determined so as to bring the regulating knob into the neutral position, and the motor 36 in the direction corresponding either to an increase or to a decrease of the space between the blade 1 and the inking roller 2.

The value of the displacement of the ring 8 acting on the blade 1 depends on the period of excitation of the motor 36 and therefore of the motor 51, since these two motors are excited at the same time by the same switch, either 49 or 50. It follows that the displacement of the ring 8 is proportional to the angular displacement of the regulating knob 39, the return of which to the neutral position is ensured by the motor 51.

The transmission ratios, on the one hand between the motor 51 and the cam-disc 43, and on the other hand between the motor 36 and the driving shaft 17, are advantageously calculated so that the angle of rotation of the shaft 17 is equal to the angle through which the regulating knob has been moved.

Thus the inking device comprises a remote control device for the motors 36, comprising a rotary switch 43 for controlling the direction of rotation of the motor 36 associated with the regulating screw 9, and a motor 51 to restore said switch 43 to its neutral position and for controlling the duration of excitation of the motor 36 driving said regulating screw 9.

The electrical connections, which are not shown and are within the scope of those skilled in the art, are made in such manner that after displaying the desired value or regulation by means of the knobs 39, the depression of one of the push-buttons 56*a*, 56*b*, 56*c* or 56*d* effects the putting into operation of the differential regulating screws in the zones of the inking roller or rollers corresponding respectively to the first, second, third or fourth page.

The push-button 57 controls the putting into action of one or several regulating screws in these same zones up to the complete closure or opening of the space between the blade 1 and the inking roller 2, depending on the position of knobs 39 the shoulder 14 coming into abutment against the socket 7 in the complete closure position.

Furthermore, during the course of the operation, the putting into action of the jack controlling the lever 27, by means of the push-buttons 58*a*, 58*b*, 58*c* and 58*d* enables the space between the blade 1 and the inking roller 2 to be closed in the zones of the inking roller or rollers corresponding respectively to the first, second, third or fourth page, without modifying the regulation of the differential screws. The exact position of closure is obtained by acting on the threaded rod 29.

Figure 8:
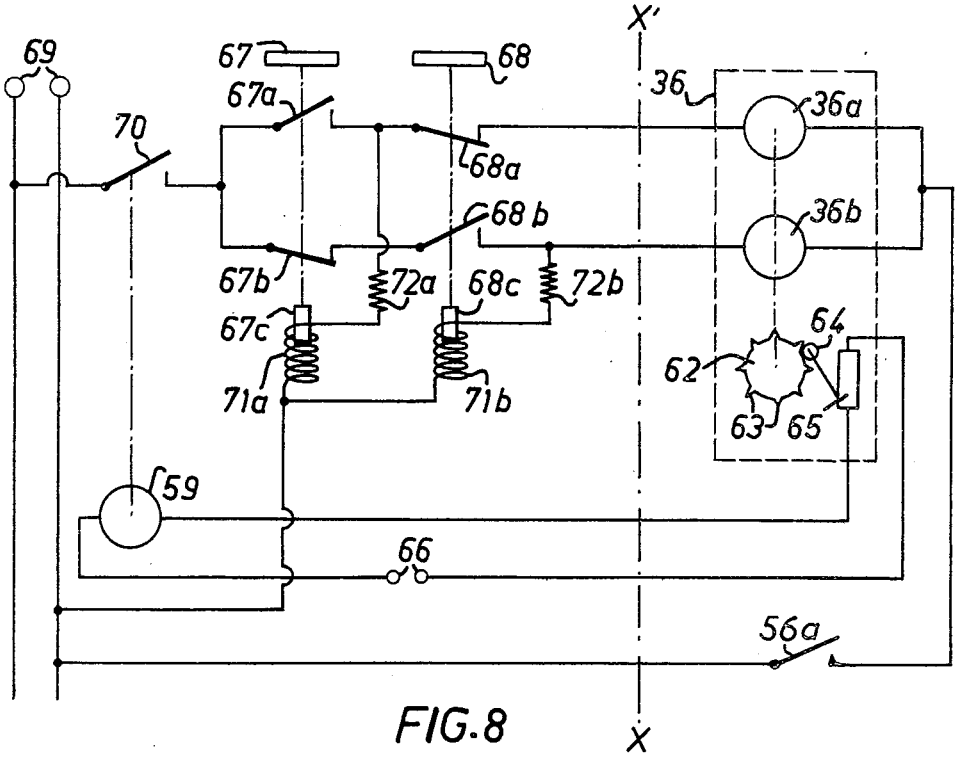
FIG. 8 is a diagrammatic view of a second form of embodiment of the remote-control device.
Figure 9:
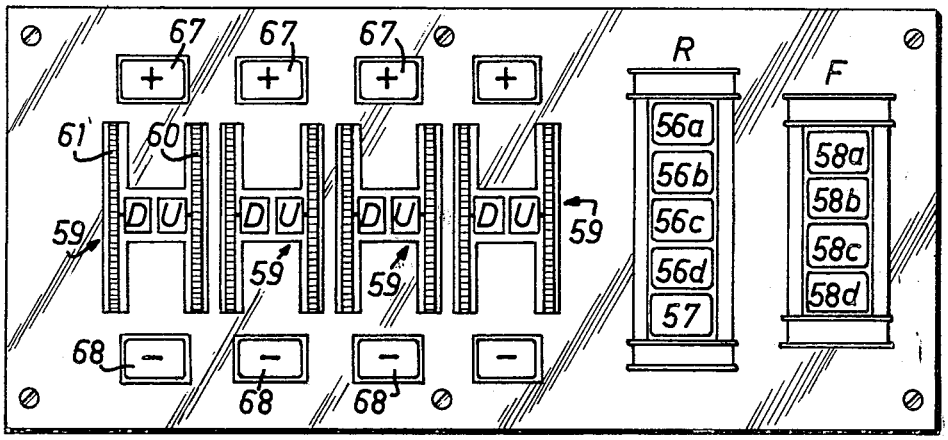
FIG. 9 is a view in elevation of the operating switchboard of this second form of embodiment.

The motor-reduction gear set 36 may also be remote-controlled by means of the arrangement shown diagrammatically in FIGS. 8 and 9, in which the elements in common with the devices of the previous figures have been given the same references.

In these figures, the regulating knobs 39 of the control panel shown in FIG. 7 are replaced by meters or counters 59 on which a number, at most equal to 99 in the example shown, cann be manually displayed by acting on the knurled knobs 60 and 61. The knob 60 controls the units figure which appears in the window U and the knob 61 the tens figure which appears in the window D.

Each counter 59 is associated with an impulse generator actuated by the motor-reduction gear 36 and constituted for example by a wheel 62 fixed on the output shaft of the motor-reduction gear 36 and provided with teeth or studs 63, eight in number in the example shown. On the wheel 62 is supported a roller 64 coupled to a switch 65 connected in series with the counter 59 on a circuit connected to the terminals 66 of a direct current supply source (not shown).

Two push-buttons 67, 68 are associated with each counter and are mounted on the control panel, facing the counterr 59. They are respectively marked with the sign "plus" and the sign "minus" and control the motor-reduction gear 36 in the direction either of inncreasing the space between the blade 1 and the inking roller 2 for the push-button 67 or of the reduction of this space for the button 68. Each of the buttons 67 and 68 is coupled to two single-pole switches 67*a*, 67*b* and 68*a*, 68*b*.

The motor-reduction gear set 36 comprises two motors 36*a* and 36*b* keyed on the same shaft, the motor 36*a* serving to cause the set to rotate in one direction of rotation and the motor 36*b* in the opposite direction. The motor 36*a* is placed in series with the switches 67*a* and 68*a* and the motor 36*b* is in series with the switches 67*b* and 68*b*. The circuits of the two motors 36*a* and 36*b* are connected in parallel to the terminals 69 of an alternating current source through the intermediary on the one hand of a switch 70 coupled to the counter 59 and on the other hand of another switch which is the switch 56*a* in the partial diagram of FIG. 8.

The push-buttons 67 and 68 are provided with an electric latching device each constituted by a plunger 67*c*, 68*c*, forming the moving core of an electro-magnet shown diagrammatically in FIG. 8 by a solenoid 71*a*, 71*b*. The solenoid 71*a* is connected in series with a resistance 72*a* between one of the terminals 69 and the circuit of the motor 36*a*. Similarly, the solenoid 71*b* is connected in series between the same terminal 69 and the circuit of the motor 36*b*.

The control panel shown in FIG. 9 comprises, like that of FIG. 7, vertically below a reference R, five push-buttons 56*a*, 56*b*, 56*c*, 56*d* and 57 and, vertically below a reference marked F, four push-buttons 58*a*, 58*b*, 58*c* and 58*d*.

In FIG. 8, the coupling of the members is shown diagrammatically by chain-dotted lines.

The operation of this arrangement is as follows:

At the outset, the counter 59 is at zero and the various switches occupy the positions shown in FIG. 8, the switches 67*a*, 68*b* and 70 being open and the switches 67*b* and 68*a* closed. The switches 56*a*, 56*b*, 56*c* and 56*d* are open, only the switch 56*a* being shown in FIG. 8.

After having chosen the page to be regulated by means of one of the push-buttons 56*a*, 56*b*, 56*c* or 56*d*, that is to say after having closed one of these switches, 56*a* for example, the operator registers on the counter 59 the value or regulation to be effected. As soon as a regulation value is displayed, the switch 70 closes, its opening being automatic during the return of the counter to zero. If the operator wishes to increase the space between thhe blade 1 and the roller 2, he depresses the button 67 which causes the closure of the switch 67*a* and the opening of 68*b*. The circuit of the solenoid 71*a* is then closed and this solenoid maintains the push-button 67 in the position of closure of 67*a* and the opening of 67*b* through the intermediary of the plunger 67*c*.

The circuit of the motor 36*a* is at that moment closed and the motor-reduction gear 36 rotates in the direction corresponding to an increase in the quantity of ink retained by the inking roller 2. The wheel 62 rotates with the motor-reduction gear 36 and the passage of each stud 63 acts on the switch 65 which sends an impulse to the counter 59 at each passage. Each impulse causes the reduction by one unit of the value displayed on the counter. When this latter has returned to zero, the switch 70 opens; in consequence, the rotation of the motor 36*a* stops and the solenoid 71*a* is no longer excited. Restoring members (not shown) return the switches 67*a*, 67*b* into the position shown in FIG. 8.

It can thus be seen that the motor 36*a* is excited in such manner as to cause the output shaft of the motor-reduction gear to rotate by a number of revolutions equal to the number displayed on the counter 59, divided by the number of studs 63 of the wheel 62.

Similarly, if the operator desires to reduce the quantity of ink on the roller 2, after displaying the value of regulation desired, he actuates the push-button 68, opening 68*a* and closing 68*b* and therefore closing the circuit of the motor 36*b*.

It will be easily understood that a single counter 59 may serve for the regulation of a differential screw for each page printed, all the members located on the left of the line X'–X in FIG. 8 being the same for several pages, the members 36, 62, 63, 64 being different for the control of each page. For each page, the motors 36*a*, 36*b* and the switch 65 are connected in shunt and the switch 56*a* is replaced by a switch 56*b*, 56*c* or 56*d*, the motor circuits of a single page being under the control of a single switch 56*a*, 56*b*, 56*c*, or 56*d*.

It will be understood that the present invention has only been described and shown by way of preferred example and that equivalence may be brought into its constituent elements without thereby departing from the scope of the said invention as defined in the appended claims.

I claim:

1. An inking device for printing machines comprising an ink fountain, means for creating a flow of ink from said ink fountain, means for adjusting said flow of ink including a rotationally adjustable ink control element and a first electrically reversible synchronous motor, means for drivably connecting said synchronous motor with said ink control element to effect adjustment thereof at a predetermined angular speed, a control device comprising a presetting element manually rotatable through various angular displacements in either of two directions from a neutral position, a second electrically reversible synchronous motor drivably connected to said presetting element to drive said presetting element rotationally from said various displacements to said neutral position at the same angular speed as said predetermined angular speed, and switch means actuatable by said presetting element upon angular displacement thereof for simultaneously energizing said first and second synchronous motors in a common direction with an AC voltage to drive said presetting element in a direction toward said neutral position and to rotationally adjust a corresponding one of said ink control elements, said switch means further comprising means for de-energizing said first and second synchronous motors upon arrival of said presetting element at said neutral position.

2. An inking device as defined in claim 1 and wherein said presetting element further comprises a friction clutch means constructed and arranged for drivably connecting said second motor to said presetting element when said second motor is energized, and for slipping when said presetting element is rotated manually.

3. An inking device as defined in claim 1 and further comprising additional ones of said means for adjusting, and associated respectively therewith in sets, additional ones of said means for connecting, and further comprising means for associating into groups a plurality of sets of said means for adjusting and means for connecting, and wherein said inking device further comprises additional ones of said control devices, and further comprises selector switch means for selecting simultaneously one of said groups for control by said control devices, one first synchronous motor of each group being ennergized respectively by one of said control devices.

4. An inking device for a printing machine comprising a cross-frame, an inking roller, means for rotatably supporting said inking roller adjacent said cross-frame, blade means for regulating ink film thickness on said inking roller and having its first extremity fixed to the cross-frame, the second extremity of said blade means being located in the vicinity of the periphery of said inking roller and having portions selectively positionable a regulatable space away from said periphery, said blade means being flexible, regulating means including screws rotatable to produce axial movement thereof with respect to said cross frame, said screws having means associated therewith and engageable with said second extremity of the flexible blade means for transmitting force in one direction to respective portions of said second extremity upon rotation of said screws, in order to regulate said space between said second extremity and said periphery of the inking roller, and separate rotary electric motors each having a continuously rotatable rotor drivably connected with a respective one of said screws for rotating said respective one of said screws, each of said screws comprising a rrod having first and second threaded portions, said regulating means further comprising a socket fixed to said cross-frame and having threads engaging said first threaded portion, a first ring slidably mounted for permitting axial displacement of said first ring with respect to said cross-frame and having threads engaging said second threaded portion, the thread pitch of the first threaded portion being different from that of the second threaded portion, and means for preventing rotation of said first ring including a second rind rigidly fixed to said first ring provided with grooves, and nipples fixed on an extremity of said socket and slidably engaged in the grooves of said second ring.

* * * * *

United States Patent [19]

Johnson

[11] 3,968,747

[45] July 13, 1976

[54] PRINTING APPARATUS

[75] Inventor: Leonard L. Johnson, Fort Wayne, Ind.

[73] Assignee: Lincoln Logotype Co., Inc., Fort Wayne, Ind.

[22] Filed: Jan. 27, 1975

[21] Appl. No.: 543,991

[52] U.S. Cl. ..... 101/376; 29/126; 267/140

[51] Int. Cl.[2] ..... B41F 13/10

[58] Field of Search..... 101/35, 36, 110, 375–377, 101/379, 380, 381; 29/124, 125, 126; 267/140, 141, 152, 153

[56] References Cited

UNITED STATES PATENTS

| | | | |
|---|---|---|---|
| 199,460 | 1/1878 | Morgans | 101/377 |
| 2,085,323 | 6/1937 | Leash | 101/376 |
| 2,475,524 | 7/1949 | Scott et al. | 101/376 |
| 2,761,547 | 9/1956 | Gehrer | 29/126 X |
| 2,804,968 | 9/1957 | Elliot et al. | 29/126 X |
| 2,910,938 | 11/1959 | McKenzie | 101/377 |
| 3,467,010 | 9/1969 | King | 101/376 |
| 3,677,017 | 7/1972 | Shirvany | 267/140 X |
| 3,824,932 | 7/1974 | Aronson | 101/377 |

*Primary Examiner*—Edgar S. Burr
*Assistant Examiner*—Edward M. Coven

[57] ABSTRACT

A printing apparatus comprises a wheel having at least two spaced parallel sides. A type-supporting member is slidably mounted between said sides for radial movement, the wheel being open radially outwardly from this supporting member to receive a segment of rubber type. A spring of resilient, rubber-like material, in columnar form extends radially of the wheel between the sides, being secured at its radially outer end to the supporting member and at its inner end to the central portion of the wheel. Radially inward movement of the supporting member causes flexure of said spring which reacts with a corresponding force. A type segment mounted on said type-supporting member will be impressed against a surface to be imprinted depending upon the reactionary force exerted by the flexed spring. Since the spring is in columnar form, the reactionary force exerted by the spring is fairly constant for varying degrees of flexure thereby providing a fairly uniform force of engagement of the type face with an irregular surface as the type face moves between the high and low points thereon.

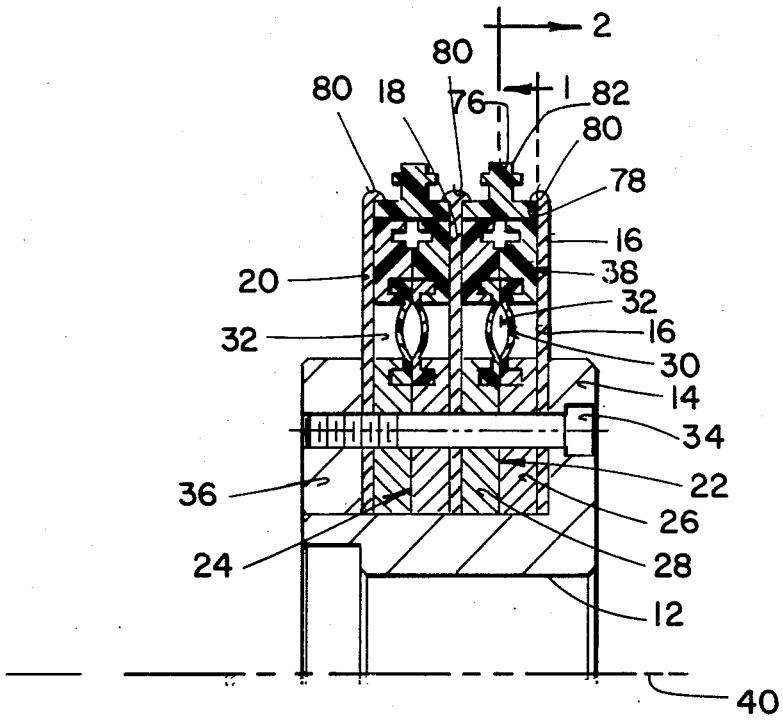

23 Claims, 13 Drawing Figures